US006416628B1

(12) United States Patent
Huang et al.

(10) Patent No.: US 6,416,628 B1
(45) Date of Patent: Jul. 9, 2002

(54) METHOD OF PRODUCING DIMENSIONALLY STABLE PAPER AND PAPERBOARD PRODUCTS

(75) Inventors: Yan C. Huang, Campbell Hall; Murray Bruce Lyne, Tuxedo Park, both of NY (US); Clifford Kent Hatcher, Cordova, TN (US); Gurudatta D. Nadkarni, Mableton, GA (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/217,391

(22) Filed: Dec. 21, 1998

Related U.S. Application Data

(60) Provisional application No. 60/073,458, filed on Dec. 22, 1997.

(51) Int. Cl.[7] ..... D21H 17/62; D21H 17/60; D21H 21/16

(52) U.S. Cl. ..... 162/180; 162/158; 162/205; 162/206; 162/207; 162/173; 162/172; 162/168.2; 162/169; 162/184

(58) Field of Search ..... 162/180, 158, 162/169, 173, 172, 168.1, 168.2, 168.3, 164.6, 164.1, 183, 184, 204–207

(56) References Cited

U.S. PATENT DOCUMENTS

| | | | | | |
|---|---|---|---|---|---|
| 2,629,648 | A | | 2/1953 | Ericks | 8/115.6 |
| 2,629,674 | A | | 2/1953 | Ericks | 117/140 |
| 2,629,701 | A | | 2/1953 | Ericks | 260/29.3 |
| 2,692,183 | A | | 10/1954 | Ericks | 8/115.6 |
| 2,772,966 | A | | 12/1956 | Daniel et al. | 92/3 |
| 3,203,851 | A | * | 8/1965 | Blau et al. | 162/168.1 |
| 3,250,666 | A | | 5/1966 | Clark et al. | 162/169 |
| 3,271,239 | A | * | 9/1966 | Hornbostel, Jr. | 162/169 |
| 3,319,352 | A | * | 5/1967 | Haigh | 34/123 |
| 3,354,035 | A | * | 11/1967 | Gottwald et al. | 162/206 |
| 3,755,069 | A | | 8/1973 | Crawford et al. | 162/135 |
| 3,847,637 | A | * | 11/1974 | Luszczak | 106/271 |
| 3,865,769 | A | * | 2/1975 | Davison | 162/168.1 |
| 3,908,071 | A | * | 9/1975 | Heim et al. | 428/323 |
| 4,110,155 | A | | 8/1978 | Minagawa et al. | 162/135 |
| 4,133,688 | A | | 1/1979 | Sack | 96/87 R |
| 4,152,198 | A | | 5/1979 | Serota et al. | 162/128 |
| 4,219,382 | A | | 8/1980 | Leffler | 162/180 |
| 4,288,287 | A | | 9/1981 | Miyama et al. | 162/135 |
| 4,331,508 | A | | 5/1982 | Miyama et al. | 162/135 |
| 4,437,894 | A | * | 3/1984 | Emerson, Sr. | 106/238 |
| 4,483,744 | A | * | 11/1984 | Emerson, Sr. | 162/180 |
| 4,510,019 | A | | 4/1985 | Bartelloni | 162/144 |
| 4,522,686 | A | | 6/1985 | Dumas | 162/158 |
| 4,810,301 | A | | 3/1989 | Yoshioka et al. | 106/287.24 |
| 4,849,131 | A | | 7/1989 | Sweeny | 252/312 |
| 4,919,725 | A | * | 4/1990 | Jones | 106/218 |
| 4,935,097 | A | | 6/1990 | Tashiro et al. | 162/135 |
| 4,994,147 | A | * | 2/1991 | Foley et al. | 162/137 |
| 5,084,354 | A | | 1/1992 | Krankkala et al. | 428/414 |
| 5,160,484 | A | | 11/1992 | Nikoloff | 427/439 |
| 5,171,404 | A | * | 12/1992 | Ellis et al. | 162/206 |
| 5,178,936 | A | | 1/1993 | Kamiya et al. | 428/218 |
| 5,194,362 | A | | 3/1993 | Nakabayashi et al. | 430/203 |
| 5,254,450 | A | | 10/1993 | Lacz et al. | 430/538 |
| 5,362,614 | A | | 11/1994 | Serizawa et al. | 430/538 |
| 5,367,009 | A | | 11/1994 | Inoue et al. | 524/272 |
| 5,374,335 | A | | 12/1994 | Lindgren et al. | 162/158 |
| 5,378,497 | A | * | 1/1995 | Johnson et al. | 427/211 |
| 5,510,003 | A | * | 4/1996 | Colasurdo et al. | 162/158 |
| 5,543,231 | A | | 8/1996 | Kidon et al. | 428/447 |
| 5,626,719 | A | * | 5/1997 | Tansley et al. | 162/158 |
| 5,669,159 | A | * | 9/1997 | Orloff et al. | 34/398 |
| 5,741,889 | A | | 4/1998 | Huang et al. | 530/210 |

FOREIGN PATENT DOCUMENTS

| | | |
|---|---|---|
| GB | 2 293 612 A | 4/1996 |
| SU | 496976 | 8/1978 |

* cited by examiner

*Primary Examiner*—Jose Fortuna
(74) *Attorney, Agent, or Firm*—Ostrager Chong & Flaherty LLP

(57) ABSTRACT

A method of producing dimensionally stable paper and/or paperboard products by treating a hygroreactive cellulosic fiber matrix with a hydrophobic sizing agent solution; and drying the treated fibers using heat and/or pressure so that the hydrophobic sizing agent penetrates the fiber matrix making it hydrophobic.

18 Claims, 7 Drawing Sheets

X-RAY ELEMENTAL MAP OF TREATED SAMPLES

HYDROPHOBE 6 TREATED SAMPLES DRIED CONVENTIONALLY

HYDROPHOBE 6 TREATED SAMPLES USING CONDEBELT

NOTE: ERROR BAR IS 6%
PICKUP IS ~ 27 lb/ton APPLIED AS A DRAW DOWN

NOTE: ERROR BAR IS 7%
THEREFORE THE DIFFERENCES SEEN HERE ARE MINIMAL
SOLID SYMBOLS INDICATE SURFACE SIZE
HOLLOW SYMBOLS INDICATE INTERNAL SIZE

METHOD OF PRODUCING DIMENSIONALLY STABLE PAPER AND PAPERBOARD PRODUCTS

CROSS-REFERENCE TO RELATED APPLICATIONS

This application claims priority of provisional U.S. patent application Ser. No. 60/073,458, filed Dec. 22, 1997. The text of the provisional application is incorporated by reference herein.

FIELD OF THE INVENTION

The invention relates to a method of producing paper products made from a hygroreactive cellulosic fiber matrix sized with a hydrophobic material. The products produced are more dimensionally stable under cyclical humidity conditions than conventional paper products.

BACKGROUND OF THE INVENTION

Conventional paper and paperboard products are made from hygrocellulosic fibers. These fibers tend to absorb moisture and swell in environments of high humidity and they tend to shrink in low humidity conditions. This dimensional instability in paper and paperboard products leads to problems such as curl, misregistering in printing, bulge, cockle, warp and compressive creep.

For example, a two sided polyethylene extruded release liner was found to exhibit wavy edges in cyclical humidity conditions. This in turn leads to product performance problems such as misregistration in a multicolor printing process.

These end use problems often result in costly project rejects. Thus, there is a need for dimensionally stable paper and paperboard products.

U.S. Pat. No. 3,753,069 to Crawford, U.S. Pat. No. 4,110,155 to Minogawa, U.S. Pat. No. 4,288,287 to Miyama, U.S. Pat. No. 4,331,508 to Miyoma, U.S. Pat. No. 5,178,936 to Kamiya, U.S. Pat. No. 5,194,362 to Nakabayashi, U.S. Pat. No. 5,254,450 to Lacy and U.S. Pat. No. 5,362,614 to Serizawa generally disclose resin coated photographic papers wherein resin stabilizers and/or antioxidants are incorporated into the paper core to help eliminate curl.

The prior art has shown use of sizing agents and paper saturants in the paper industry. Representative of these patents include U.S Pat. Nos. 2,692,183, 2,629,648, 2,629,674 and 2,629,701 to Ericks; U.S. Pat. No. 4,133,688 to Sack, U.S. Pat. No. 4,152,190 to Serota, U.S. Pat. No. 4,522,686 to Dumas, U.S. Pat. No. 4,810,301 to Yoshioka, U.S. Pat. No. 4,849,131 to Sweeney, U.S. Pat. No. 4,935,097 to Tashiro, U.S. Pat. No. 5,160,484 to Nikoloff, and U.S. Pat. No. 5,374,335 to Lindgren.

Unlike the prior art, the present invention overcomes the problems typically associated with hygroreactive cellulosic fibers by providing paper and paperboard products that are more dimensionally stable under cyclical humidity conditions than conventional paper products.

Accordingly, it is a broad object of the invention to provide a dimensionally stable reprographic paper produced by sizing a cellulosic fiber matrix with a hydrophobic material. This technique reduces the hygroexpansion of the paper thus creating more dimensionally stable paper and paperboard products.

Another object of the invention is to reduce hygroexpansion of paper by approximately 40%, therefore creating more dimensionally stable paper and paper board. The technique involves a hydrophobic treatment of the paper which is then dried using heat and/or pressure.

A specific object of the invention is to provide a dimensionally stable release liner that is more stable against moisture changes and lays flat when subjected to cyclical humidity conditions. The base sheet of the release liner is surface sized with a hydrophobic material which permits adhesion of a polyethylene coating without the use of a primer or adhesion coating.

Another more specific object of the invention is to provide a dimensionally stable release liner having a balanced coating, i.e. using the same polyethylene on either side of the base sheet as well as the same coat weight on either side.

Another object of the invention is to provide a dimensionally stable paper or paperboard product with improved lay flat characteristics by surface sizing the base sheet to create a non-hygro reactive paper or paperboard.

SUMMARY OF THE INVENTION

In the present invention, these purposes, as well as others which will be apparent, are achieved generally by providing a process for producing dimensionally stable paper and paperboard by treating with hydrophobic materials to reduce the hygroexpansion of paper.

The process of the invention involves soaking the paper or paperboard in a dispersion of hydrophobes followed by drying using heat and/or pressure. Under pressure and/or heat the hydrophobe penetrates the paper fiber matrix making the fiber matrix hydrophobic, thus moisture is prevented from penetrating or exiting the fiberwall reducing fiber swelling and reswelling and the concomitant network expansion and contraction.

Various hydrophobic agents are used in the invention process. A preferred material is a modified cationic rosin emulsion. Other hydrophobic agents used in the invention process include ethylene oxide and propylene oxide block copolymer; polyethylene acrylate; alkyltrimethoxysilane; styrene acrylate copolymer dispersion; and polyurethane.

The dispersion of hydrophobic agents is preferably between 2 to 20 wt. %. solids. In addition to the hydrophobic agent the dispersion comprises a hydrophilic sizing agent such as starch. The amount of starch used is typically between 8 to 12 wt. %. Other sizing materials used in preparing the invention include starch solutions such as ammonium persulfate converted pearl starch and Penford Gum 290. In a preferred embodiment the dispersion comprises approximately 1% hydrophobic agent, 10% starch and 89% water.

In general the invention provides a dimensionally stable reprographic paper and/or paperboard wherein the base sheet comprised of a hygroreactive cellulosic fiber matrix is sized with a hydrophobic agent. The resulting treated paper or paperboard is hydrophobic and has a contact angle of 90° or greater.

In accordance with a specific embodiment of the invention, a two-sided polyethylene extruded release liner is produced. The base sheet is prepared in accordance with the invention process. Preferably the base sheet is treated with a hydrophobic solution, preferably a modified cationic resin (commercially available as Sizeall XR 4177 from Ariziona Chemical, Panama City, Fla.) and then coated with two sheets of polyethylene on opposite sides of the base sheet to form the release liner.

Other objects, features and advantages of the present invention will be apparent when the detailed description of the preferred embodiments of the invention are considered with reference to the drawings, which should be construed in an illustrative and not limiting sense as follows:

DETAILED DESCRIPTION OF THE INVENTION

Figure 1:
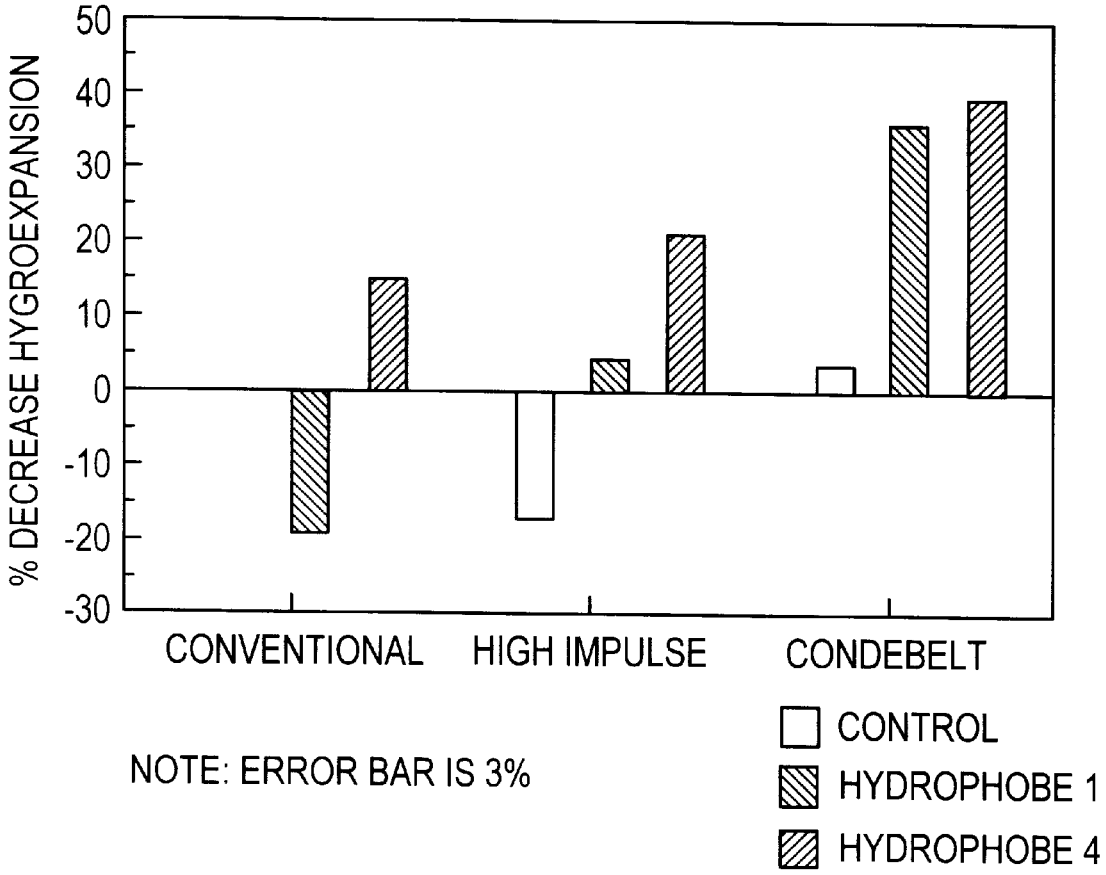
FIG. 1 is a graphic illustration comparing the different drying techniques, conventional, high impulse and Condebelt, for paper hygroreactivity of control samples and samples treated with Hydrophobes 1 and 4 in accordance with the invention.

In accordance with the present invention dimensionally stable paper and/or paperboard products are provided by treating a hygroreactive cellulosic fiber matrix with a hydrophobic agent solution and drying the treated fibers using heat and/or pressure so that the hydrophobic agent penetrates the fibers making the fiber matrix hydrophobic.

The hydrophobic agent is applied to the fiber matrix in a dispersion. The dispersion is preferably between 2 to 20 wt. % solids and also includes a sizing agent such as starch. The amount of starch in the solution is typically between 8 to 12 wt. %, preferably 10 wt. %. Other sizing materials used in preparing the invention include starch solutions such as ammonium persulfate converted pearl starch and Penford Gum 290. These sizing materials are hydrophilic, however, they are combined with the hydrophobic agents of the invention, and when applied to the fiber matrix result in a hydrophobic surface size. In a preferred embodiment the dispersion comprises approximately 1% hydrophobic agent, 10% starch and 89% water.

The hydrophobic agent typically comprises up to 1 wt. % of the dispersion and is preferably a modified cationic rosin emulsion comprised of emulsified cationic rosin solids (10–40%) and 1–6% of a water soluble salt of an alkylene-acrylic acid copolymer, preferably a water soluble salt of a polyalkylene-acrylic acid copolymer. This material is commercially available as Sizeall from Arizona Chemical, Panama City, Fla., and is described in U.S. Patent Application to Huang et al. entitled "Modified Rosin Emulsion", which was filed on Apr. 29, 1996 and assigned Ser. No. 08/639,399. This application in its entirety is incorporated herein by reference.

Other hydrophobic agents used in the invention process and include ethylene oxide and propylene oxide block copolymer, commercially available as Pluronic L92 and L121 from BASF Corporation Chemicals Division, Charlotte, N.C.; polyethylene acrylate, commercially available as Pea 4983 and 4990 from Michelman Inc., Cincinnati, Ohio, a preferred PEA copolymer used has an average molecular weight of about 8000; turpene dimer commercially available from Arizona Chemical, Panama City, Fla.; alkyltrimethoxysilane commercially available as Silane 6124 from Down Corning, Midland, Mich.; styrene acrylate colpolymer dispersion, commercially available as Basoplast from BASF Corporation Chemicals Division, Charlotte, N.C.; chromium stearate, commercially available as Quilon C from E.I. DuPont de Nemours & Co., Wilmington, Delaware; and polyurethane, commercially available as Graphsize.

Depending on the hydrophobic agent used a surfactants, such as the cationic surfactant aluminum sulfate or the nonionic surfactant commercially available as Luredur, may be included in the dispersion. The use of a surfactant mixed together with the hydrophobic agent enhances the surface wettablity and further enhances the penetration of the hydrophobic agent into the fiber matrix.

In general the invention provides a dimensionally stable reprographic paper and/or paperboard wherein the base sheet comprised of a hygroreactive cellulosic fiber matrix is sized with a hydrophobic agent. The resulting treated paper or paperboard is hydrophobic and has a contact angle of 90° or greater.

The invention also provides a release liner comprised of a base sheet comprised of a matrix of hygroreactive cellulosic fibers which have been sized with a hydrophobic agent, wherein said hydrophobic agent penetrates the fibers making the fiber matrix hydrophobic. The base sheet is coated with at least one sheet of polyethylene. The liner of the invention is stable against moisture changes and lays flat when subjected to cyclical humidity conditions.

The following examples illustrate various aspects of the invention but are not to be interpreted as limiting it.

EXAMPLE I

The treatment technique investigated in this example simulates that of Condebelt drying conditions. The paper was treated with a hydrophobic sizing agent to prevent absorption of water, thereby reducing hygroreactivity and increasing dimensional stability.

The hydrophobic agents used in this example include:

Hydrophobe 1—a modified cationic rosin emulsion, commercially available as Sizeall from Arizona Chemical, Panama City, Fla.

Hydrophobe 2—styrene acrylate copolymer dispersion, commercially available as Basoplast from BASF Corporation Chemicals Division, Charlotte, N.C. combined with a nonionic surfactant, commercially available as Luredur. The materials are combined in the amounts of 98% and 2%, respectively.

Hydrophobe 3—polyurethane dispersion, commercially available as Graphsize.

Hydrophobe 4—ethylene oxide and propylene oxide block copolymer, commercially available as Pluronic L92 and L121 from BASF Corporation Chemicals Division, Charlotte, N.C.

Hydrophobe 5—polyethylene acrylates, commercially available as Pea 4983 and 4990 from Michelman Inc., Cincinnati, Ohio.

Hydrophobe 6—chromium stearate, commercially available as Quilon C from E.I. DuPont de Nemours & Co., Wilmington, Del.

Hydrophobe 7—alkyltrimethoxysilane commercially available as Silane 6124 from Down Corning, Midland, Mich.

Hydrophobe 8—turpene dimer commercially available from Arizona Chemical, Panama City, Fla.

Unsized reprographic paper was used in this example. The samples were prepared in accordance with the invention process by dipping them in the dispersions of Hydrophobes 1 to 8 listed above for approximately 1 minute. The hydrophobe solutions were prepared as either "low" or "high" solutions. The "low" solutions were prepared such that 2 lbs of hydrophobe was used per ton of paper (2,000 lbs); and in the "high" solutions 6 lbs of hydrophobe was used per ton of paper. After soaking in the hydrophobe the samples were then dried in one of the following ways:

(1) Conventional technique: The soaked samples were couched and then dried on a bench top drier for approximately 30 seconds per side under restraint.

(2) Condebelt technique: The soaked samples were placed on a felt and hot press dried between two plattens. The pressure (~200 psi) and temperature (~300 F) was applied for a duration of 5 seconds. Only a circular area in the center of the sample was dried and the edges of the sample were not dry. The edges of the samples were then dried using the conventional technique.

(3) High Impulse technique: The soaked samples were placed on a felt and hot press dried between 2 plattens. The pressure (~400 psi) and temperature (~400 F) was applied for a duration of 15 milli secs. The edges of the sample were not dry so the samples were then dried using the conventional technique.

The hygroreactivity of the samples was measured using the Varidim Expansimeter. The samples were equilibrated at 50% RH (for 2 hours), 20% RH (for 4 hours) and 90% RH (for 6 hours). For some runs the conditions were cycled to test for hysteresis effects. The hygroreactivity was compared to the sample treated with water using the conventional method. This sample was used as a control, since it displayed the most consistent results across the different runs.

The hygroreactivity data, summarized in Table I below, reveals that the sized samples dried using the Condebelt technique were the least hygroreactive, followed by the high impulse dried samples and finally the conventionally dried samples. FIG. 1, illustrates the best two treatments from TABLE 1A thru 1I compared to the control sample treated with water only. The samples dried conventionally do not have improved hygroreactivity. Thus, it is preferred for the heat and pressure to be present for an improved product. However, the heat and pressure are not solely responsible for the decrease in hygroreactivity as can be seen in the control samples where there was no improvement in hygroreactivity (samples treated only with water and dried in different ways). A significant decrease in reactivity occurs when the hydrophobes are present.

The hygroreactivity can be measured as a percentage performance, which is the percent change in length of the treated sample compared to the change in length of the control. The control is the sample wet in water and dried in a conventional manner. The samples can be grouped in decreasing order of hygroreactivity as follows:

Group A—Hydrophobes 1 and 4 both showed a decrease of 35–45% in the hygroreactivity when compared to the control.

Group B—Hydrophobes 5, 7 and 8 showed a decrease of 25–35% in the hygroreactivity when compared to the control.

Group C—Hydrophobes 2, 6, 7, water (with condebelt)—showed a decrease of <18% in the hygroreactivity when compared to the control.

Figure 2:
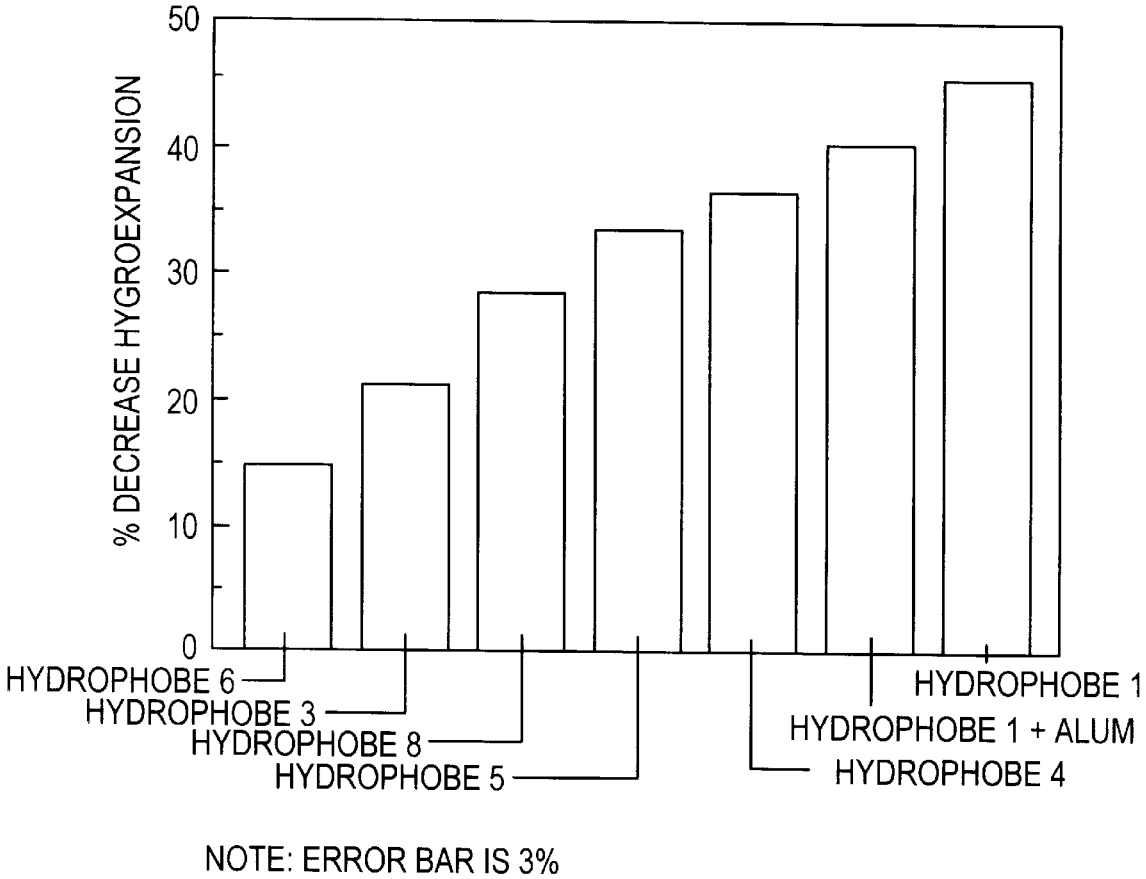
FIG. 2 is a graphic illustration comparing different chemical treatments for paper hygroreactivity of various samples treated with Hydrophobes 6, 3, 8, 5, 1, 1 with alum and 4 in accordance with the invention.

FIG. 2 illustrates the effectiveness of the top chemical treatments. TABLES 1A thru 1I summarizes the entire data for the chemical treatments investigated and the reductions of hygroexpansion, if any. As discussed above, the hydrophobe solutions were prepared as "low" and "high" solutions, in the tables below, unless indicated as a "high" solution, the solutions were "low".

TABLE 1A

HYGROREACTIVITY PERFORMANCE OF UNTREATED AND CONTROL SAMPLES

| SAMPLE | DRYING TECHNIQUE | % DL OF CONTROL | STANDARD DEVIATION |
|---|---|---|---|
| UNTREATED PAPER | 1 | 92 | 2.2 |
| CONTROL/WATER | 3 | 100 | 2.9 |
| CONTROL/WATER | 2 | 117.2 | 4.5 |
| CONTROL/WATER | 1 | 96.1 | 3.8 |

KEY: DRYING TECHNIQUE: 1 - Conventional; 2 - Condebelt; and 3 - High Impulse.

TABLE 1B

HYGROREACTIVITY PERFORMANCE OF HYDROPHOBE 1 SAMPLES

| SAMPLE | DRYING TECHNIQUE | % DL OF CONTROL | STANDARD DEVIATION |
|---|---|---|---|
| HYDROPHOBE 1 | 1 | 119.3 | — |
| HYDROPHOBE 1 | 3 | 95.3 | — |
| HYDROPHOBE 1 | 2 | 63.4 | 1.7 |
| HYDROPHOBE 1+ | 1 | 120.6 | — |
| HYDROPHOBE 1+ | 3 | 123.1 | — |
| HYDROPHOBE 1+ | 2 | 59.6 | 1.3 |

KEY: DRYING TECHNIQUE: 1 - Conventional; 2 - Condebelt; and 3 - High Impulse.
+Cationic surfactant - aluminum sulfate 50% solution in water is included.

TABLE 1C

HYGROREACTIVITY PERFORMANCE OF HYDROPHOBE 2 SAMPLES

| SAMPLE | DRYING TECHNIQUE | % DL OF CONTROL | STANDARD DEVIATION |
|---|---|---|---|
| HYDROPHOBE 2 | 1 | 116.9 | 2.5 |
| HYDROPHOBE 2 | 3 | 102.8 | 2.4 |
| HYDROPHOBE 2 | 2 | 82.7 | 3.1 |
| HYDROPHOBE 2 | 1 | 108.8 | — |
| HYDROPHOBE 2 | 3 | 126.2 | 3.0 |
| HYDROPHOBE 2 | 2 | 89.6 | 2.0 |

KEY: DRYING TECHNIQUE: 1 - Conventional; 2 - Condebelt; and 3 - High Impulse.

TABLE 1D

HYGROREACTIVITY PERFORMANCE OF HYDROPHOBE 3 SAMPLES

| SAMPLE | DRYING TECHNIQUE | % DL OF CONTROL | STANDARD DEVIATION |
|---|---|---|---|
| HYDROPHOBE 3 | 1 | 118.7 | 2.5 |
| HYDROPHOBE 3 | 3 | 100.8 | 2.1 |

TABLE 1D-continued

| HYGROREACTIVITY PERFORMANCE OF HYDROPHOBE 3 SAMPLES | | | |
|---|---|---|---|
| SAMPLE | DRYING TECHNIQUE | % DL OF CONTROL | STANDARD DEVIATION |
| HYDROPHOBE 3 | 2 | 95.4 | 2.3 |
| HYDROPHOBE 3* | 1 | — | — |
| HYDROPHOBE 3* | 3 | 97.3 | 2.9 |
| HYDROPHOBE 3* | 2 | 93.1 | 2.0 |

KEY: DRYING TECHNIQUE: 1 - Conventional; 2 - Condebelt; and 3 - High Impulse.
*"high" solution - 6 lbs of hydrophobe per ton of paper.

TABLE 1E

| HYGROREACTIVITY PERFORMANCE OF HYDROPHOBE 4 SAMPLES | | | |
|---|---|---|---|
| SAMPLE | DRYING TECHNIQUE | % DL OF CONTROL | STANDARD DEVIATION |
| HYDROPHOBE 4 | 1 | 67.6 | — |
| HYDROPHOBE 4 | 3 | 68.5 | — |
| HYDROPHOBE 4 | 2 | 54.4 | 1.3 |
| HYDROPHOBE 4 | 1 | 85.1 | — |
| HYDROPHOBE 4 | 3 | 78.5 | — |
| HYDROPHOBE 4 | 2 | 59.8 | 1.5 |

KEY: DRYING TECHNIQUE: 1 - Conventional; 2 - Condebelt; and 3 - High Impulse.

TABLE 1F

| HYGROREACTIVITY PERFORMANCE OF HYDROPHOBE 5 SAMPLES | | | |
|---|---|---|---|
| SAMPLE | DRYING TECHNIQUE | % DL OF CONTROL | STANDARD DEVIATION |
| HYDROPHOBE 5 | 1 | 98.3 | — |
| HYDROPHOBE 5 | 2 | 66.6 | 1.6 |
| HYDROPHOBE 5 | 1 | 92.3 | 1.3 |
| HYDROPHOBE 5 | 2 | 71.4 | 1.6 |

KEY: DRYING TECHNIQUE: 1 - Conventional; 2 - Condebelt; and 3 - High Impulse.

TABLE 1G

| HYGROREACTIVITY PERFORMANCE OF HYDROPHOBE 6 SAMPLES | | | |
|---|---|---|---|
| SAMPLE | DRYING TECHNIQUE | % DL OF CONTROL | STANDARD DEVIATION |
| HYDROPHOBE 6 | 1 | 117.5 | 3.2 |
| HYDROPHOBE 6 | 3 | 119.6 | 3.0 |
| HYDROPHOBE 6 | 2 | 102.9 | 2.6 |
| HYDROPHOBE 6* | 1 | 94.5 | — |
| HYDROPHOBE 6* | 3 | 119.4 | 3.7 |
| HYDROPHOBE 6* | 2 | 85.1 | 2.9 |

KEY: DRYING TECHNIQUE: 1 - Conventional; 2 - Condebelt; and 3 - High Impulse.
*"high" solution - 6 lbs of hydrophobe per ton of paper.

TABLE 1H

| HYGROREACTIVITY PERFORMANCE OF HYDROPHOBE 7 SAMPLES | | | |
|---|---|---|---|
| SAMPLE | DRYING TECHNIQUE | % DL OF CONTROL | STANDARD DEVIATION |
| HYDROPHOBE 7 | 1 | 115.7 | 2.5 |
| HYDROPHOBE 7 | 3 | 135.0 | 3.1 |
| HYDROPHOBE 7 | 2 | 104.5 | 4.4 |
| HYDROPHOBE 7* | 1 | 109.5 | — |
| HYDROPHOBE 7* | 3 | 125.9 | 3.8 |
| HYDROPHOBE 7* | 2 | 69.7 | 2.6 |

KEY: DRYING TECHNIQUE: 1 - Conventional; 2 - Condebelt; and 3 - High Impulse.
*"high" solution - 6 lbs of hydrophobe per ton of paper.

TABLE 1I

| HYGROREACTIVITY PERFORMANCE OF HYDROPHOBE 8 SAMPLES | | | |
|---|---|---|---|
| SAMPLE | DRYING TECHNIQUE | % DL OF CONTROL | STANDARD DEVIATION |
| HYDROPHOBE 8 | 1 | 95.2 | — |
| HYDROPHOBE 8 | 2 | 71.6 | 1.8 |

KEY: DRYING TECHNIQUE: 1 - Conventional; 2 - Condebelt; and 3 - High Impulse.

TABLES 2A and 2B below summarize the wetting data of the treated samples. Measurement of the contact angle is an indication of the hydrophobicity of the samples generated. Typically, if the contact angle is 90° or greater the material is hydrophobic, less than 90° the material is hydrophilic.

TABLE 2A

| WETTABILITY DATA FOR TREATED SAMPLES | | | |
|---|---|---|---|
| SAMPLE | DRYING TECHNIQUE | CONTACT ANGLE | STANDARD DEVIATION |
| UNTREATED PAPER | | | |
| CONTROL/WATER | 1 | | |
| CONTROL/WATER | 3 | | |
| CONTROL/WATER | 2 | 76.3 | 0.3 |
| | | 57.4 | 0.5 |
| HYDROPHOBE 2 | 1 | 113.1 | 1.5 |
| HYDROPHOBE 2 | 3 | 108.5 | 1.6 |
| HYDROPHOBE 2 | 2 | 113.2 | 1.1 |
| HYDROPHOBE 3 | 1 | 111.9 | 0.6 |
| HYDROPHOBE 3 | 3 | 119.6 | 0.7 |
| HYDROPHOBE 3 | 2 | 109.9 | 1.7 |
| HYDROPHOBE 3* | 1 | 138.1 | 1.4 |
| HYDROPHOBE 3* | 2 | 125.4 | 1.7 |
| HYDROPHOBE 4 | 1 | 53.2 | 0.9 |
| HYDROPHOBE 4 | 2 | 55.8 | 0.6 |
| HYDROPHOBE 4 | 1 | 60.7 | 0.6 |
| HYDROPHOBE 4 | 2 | 60.4 | 0.7 |
| HYDROPHOBE 5 | 1 | 121.0 | 1.0 |
| HYDROPHOBE 5 | 2 | 124.0 | 0.9 |

KEY: DRYING TECHNIQUE: 1 - Conventional; 2 - Condebelt; and 3 - High Impulse.
*"high" solution - 6 lbs of hydrophobe per ton of paper.
+ Cationic surfactant - aluminum sulfate 50% solution in water is included.

TABLE 2B

WETTABILITY DATA FOR TREATED SAMPLES

| SAMPLE | DRYING TECHNIQUE | CONTACT ANGLE | STANDARD DEVIATION |
|---|---|---|---|
| HYDROPHOBE 5 | 1 | 105.3 | 2.0 |
| HYDROPHOBE 5 | 2 | 126.4 | 1.9 |
| HYDROPHOBE 6 | 1 | 128.6 | 1.1 |
| HYDROPHOBE 6 | 3 | 130.7 | 2.1 |
| HYDROPHOBE 6 | 2 | 142.4 | 3.1 |
| HYDROPHOBE 7 | 1 | 94.4 | 1.3 |
| HYDROPHOBE 7 | 3 | 92.7 | 2.2 |
| HYDROPHOBE 7 | 2 | 117.4 | 1.0 |
| HYDROPHOBE 7* | 1 | 74.4 | 1.1 |
| HYDROPHOBE 7* | 2 | 132.1 | 2.0 |
| HYDROPHOBE 1 | 1 | 112.4 | 0.8 |
| HYDROPHOBE 1 | 3 | 95.8 | 0.8 |
| HYDROPHOBE 1 | 2 | 114.8 | 1.5 |
| HYDROPHOBE 1+ | 1 | 136.0 | 1.0 |
| HYDROPHOBE 1+ | 3 | 123.0 | 1.6 |
| HYDROPHOBE 1+ | 2 | 112.7 | 0.7 |
| HYDROPHOBE 8 | 1 | 110.3 | 1.9 |
| HYDROPHOBE 8 | 2 | 115.0 | 0.9 |

KEY: DRYING TECHNIQUE: 1 - Conventional; 2 - Condebelt; and 3 - High Impulse.
*"high" solution - 6 lbs of hydrophobe per ton of paper.
+Cationic surfactant - aluminum sulfate 50% solution in water is included.

Theoretical Mechanisms for the Improved Hygroreactivity of Fibers

Several mechanisms are possible that lead to the improved properties.

A first mechanism involves insolating fibers against moisture sorption/desorption. When the fibers absorb moisture and expnd, they push the neighboring fibers to which they are bonded. The network of fibers or the paper hence undergoes a change in dimension. Under pressure/heat the hydrophobe penetrates the bleached Kraft fibers. By making the fiberwalls hydrophobic, moisture is prevented from entering or exiting the fiber wall, thus reducing fiber swelling and reswelling and concomitant network expansion and contraction. In the case of unbleached kraft fibers, at high sizing levels (30 lb/ton and higher), the hydrophobe may penetrate the fiber wall without application of a thermal pulse by virtue of favorable surface energetics for spontaneous spreading.

Alternatively, the improved hygroreactivity may be achieved by hydrophobic treatment of the bonded areas. Some fundamental research conducted to understand hot pressing processes indicate that hemicellulose in fibers flows during the hot pressing process, increasing the number of bonds in paper. If hydrophobes are provided during this process, the hydrophobes could get trapped in the bond sites. This in turn would prevent the release of dried in stresses when the samples are cycled through various humidity cycles. Total coverage of the bond sites by the hydrophobe could also help reduce hygroreactivity by preventing plasticization of the bonds by moisture.

Physical Analysis and Microscopy Results

The dominant mechanism responsible for the improved hygroreactivity was analysed by the measurement of several physical properties. Different microscopy tools were used to analyze the location of the hydrophobe in the samples. TABLE 3A and 3B contain tensile strength data of the treated samples. Tensile strength measurements showed that some chemical treatments lowered the tensile strength by approximately 15%. However, for the Hydrophobe 4 samples and Hydrophobe 6 samples the strength dropped by ~50% and for Hydrophobe 1 the drop was ~20%. The water treated control samples did not show much difference in strength for the different drying techniques. For the Hydrophobe 2 samples the strength in fact increased by ~10%. The Hydrophobe 5 treated samples did not show any decrease in strength. The decrease in tensile strength cannot be simply attributed to a debonding effect of the chemicals.

TABLE 3A

TENSILE STRENGTH DATA OF HYDROPHOBE TREATED SAMPLES

| SAMPLE | DRYING TECH. | CALIPER mil | STD DEV | STRETCH AT PEAK % | STD DEV | STRENGTH lbf/in | STD DEV |
|---|---|---|---|---|---|---|---|
| UNTREATED SAMPLE | — | 4.45 | 0.09 | 6.13 | 0.37 | 15.94 | 0.51 |
| CONTROL/ WATER | 1 | 4.68 | 0.08 | 5.69 | 0.69 | 14.54 | 0.50 |
| CONTROL/ WATER | 2 | 4.63 | 0.15 | 3.96 | 1.40 | 13.41 | 2.51 |
| HYDROPHOBE 4 | 1 | 4.82 | 0.16 | 4.44 | 1.04 | 7.26 | 0.69 |
| HYDROPHOBE 4 | 2 | 4.70 | 0.41 | 2.75 | 0.52 | 7.18 | 0.63 |
| HYDROPHOBE 1+ | 1 | 4.90 | 0.08 | 5.65 | 0.19 | 14.56 | 0.43 |
| HYDROPHOBE 1+ | 2 | 4.74 | 0.18 | 1.01 | 0.20 | 10.32 | 0.89 |
| HYDROPHOBE 1 | 1 | 5.03 | 0.20 | 5.78 | 0.31 | 15.68 | 0.18 |
| HYDROPHOBE 1 | 2 | 4.66 | 0.09 | 1.73 | 0.47 | 11.71 | 0.87 |
| HYDROPHOBE 4 | — | 6.29 | 3.16 | 3.61 | 0.27 | 7.68 | 0.57 |
| HYDROPHOBE 4 | 2 | 4.23 | 0.10 | 2.30 | 0.50 | 6.13 | 0.48 |
| HYDROPHOBE 2 | 1 | 5.01 | 0.08 | 6.13 | 0.43 | 15.95 | 0.45 |
| HYDROPHOBE 2 | 2 | 4.56 | 0.13 | 4.76 | 0.83 | 17.08 | 0.49 |

TABLE 3A-continued

TENSILE STRENGTH DATA OF HYDROPHOBE TREATED SAMPLES

| SAMPLE | DRYING TECH. | CALI-PER mil | STD DEV | STRETCH AT PEAK % | STD DEV | STRENGTH lbf/in | STD DEV |
|---|---|---|---|---|---|---|---|
| HYDROPHOBE 5 | 1 | 4.78 | 0.07 | 5.57 | 0.29 | 14.61 | 0.34 |
| HYDROPHOBE 5 | 2 | 4.19 | 0.13 | 3.40 | 0.84 | 13.35 | 2.54 |
| HYDROPHOBE 5 | 1 | 4.51 | 0.28 | 4.02 | 1.03 | 17.17 | 1.92 |
| HYDROPHOBE 5 | 2 | 4.72 | 0.09 | 4.51 | 0.37 | 15.02 | 0.97 |
| HYDROPHOBE 8 | 1 | 4.96 | 0.10 | 5.30 | 0.27 | 11.37 | 0.38 |
| HYDROPHOBE 8 | 2 | 4.35 | 0.21 | 3.35 | 0.83 | 10.42 | 1.27 |

KEY: DRYING TECHNIQUE: 1 - Conventional; 2 - Condebelt; and 3 - High Impulse.
+Cationic surfactant - aluminum sulfate 50% solution in water is included.

TABLE 3B

TENSILE STRENGTH DATA OF HYDROPHOBE TREATED SAMPLES

| SAMPLE | Young's MOE x1E + 3 lbf/in2 | STD DEV | z DIR-ECT-ION TEN-SILE lbf/in$^2$ | STD DEV | zero span tensile lbf/in$^2$ | STD DEV |
|---|---|---|---|---|---|---|
| UNTREATED SAMPLE | 300.07 | 20.53 | 101.13 | 3.55 | 33.77 | 1.11 |
| CONTROL/ WATER | 263.41 | 22.08 | 97.13 | 3.42 | 31.30 | 2.20 |
| CONTROL/ WATER | 262.39 | 10.00 | 87.30 | 2.90 | 31.80 | 1.81 |
| HYDROPHOBE 4 | 130.39 | 5.54 | 46.87 | 2.80 | 29.83 | 1.82 |
| HYDROPHOBE 4 | 149.96 | 4.01 | 33.37 | 2.17 | 29.67 | 2.21 |
| HYDROPHOBE 1+ | 284.87 | 34.79 | 97.55 | — | 31.83 | 1.79 |
| HYDROPHOBE 1+ | 422.82 | 56.01 | 75.00 | — | 26.87 | 4.55 |
| HYDROPHOBE 1 | 322.58 | 15.68 | 103.40 | — | 30.40 | 3.92 |
| HYDROPHOBE 1 | 343.46 | 115.45 | — | — | 23.83 | 1.17 |
| HYDROPHOBE 4 | 120.10 | 24.96 | 48.80 | — | 30.23 | 1.82 |
| HYDROPHOBE 4 | 152.17 | 28.28 | 38.60 | — | 29.37 | 1.50 |
| HYDROPHOBE 2 | 230.63 | 32.27 | 105.40 | — | 33.00 | 1.92 |
| HYDROPHOBE 2 | 269.73 | 54.20 | 83.80 | — | 33.90 | 1.15 |
| HYDROPHOBE 5 | 260.81 | 20.54 | — | — | 32.73 | 1.83 |
| HYDROPHOBE 5 | 309.75 | 99.68 | 92.30 | — | 31.27 | 2.31 |
| HYDROPHOBE 5 | 328.93 | 40.33 | — | – | 32.43 | 1.56 |
| HYDROPHOBE 5 | 313.14 | 25.80 | 99.33 | 5.01 | 32.13 | 0.75 |
| HYDROPHOBE 8 | 195.05 | 16.21 | 61.75 | — | 29.50 | 0.90 |
| HYDROPHOBE 8 | 221.02 | 17.04 | 48.40 | 4.08 | 30.67 | 1.32 |

KEY: DRYING TECHNIQUE: 1 - Conventional; 2 - Condebelt; and 3 - High Impulse.
+Cationic surfactant - aluminum sulfate 50% solution in water is included.

The zero span tensile strength data shows that the decrease in strength for Hydrophobe 1 samples can be attributed to a weakening of the fiber. The zero span tensile strength reduces by approximately 20% for the Hydrophobe 1 treated samples. The other samples show a marginal drop in the zero span tensile compared to the water treated control samples.

Scattering coefficients were measured for the control, and Hydrophobe 1 and 2 treated samples. The scattering coefficients were unchanged across the differently dried control samples. This indicates that the high pressure/temperature is not promoting much debonding between the fibers. The conventionally treated pluronic sample showed an increase in the scattering coefficient indicating possible debonding (confirmed by the dramatic decrease in tensile strength and no corresponding drop in the zero span tensile strength). However, the scattering coefficient for the condebelt dried sample was similar to the control condebelt result implying that either the fibers had been compressed or some bonding had taken place. The Hydrophobe 1 treated samples showed a dramatic decrease in the scattering coefficient implying that the inter fiber bonding has increased. The decreased tensile strength can thus be attributed to a chemical modification of the fiber which is supported by the zero span tensile strength.

X-Ray Elemental Analysis

Figure 3:
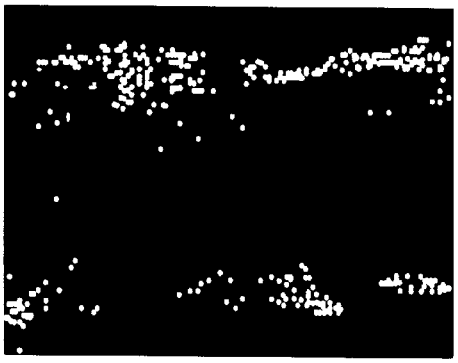
FIG. 3 is an X-ray elemental map of Hydrophobe 6 treated samples using conventional drying and Condebelt drying.
Figure 3:
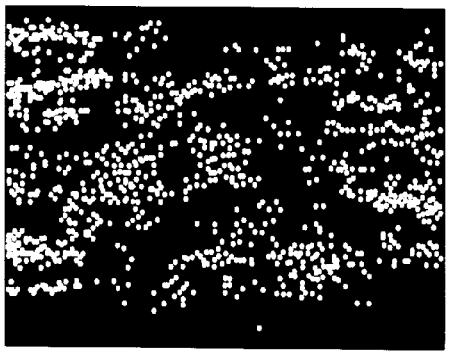

X-ray elemental analysis of cross sections of samples of the different drying techniques illustrate the differences between the procedures. Even though there is a variation from spot to spot on the treated samples the trend that can be extracted from the images of the Hydrophobe 6 treated samples is that the Hydrophobe 6 is concentrated at the top and bottom layer of the sheet for in the conventionally treated samples. The high impulse and Condebelt drying techniques infact dive in the Hydrophobe 6 samples through the sheet of the paper and appears to be rather uniform. However, there is a variation of uniformity of distribution of sizing across the sample. This may be due to the role of the pieces of dryer felt used in cushioning the impact between the two metal plattens. The underlying porosity of the dryer felt could lead to a differential pick up across the sample. FIG. 3 shows the comparison of X-ray elemental map for chromium done on a Hydrophobe 6 treated sheet when dried using conventional and condebelt drying techniques.

SEM Surface Micrographs

SEM surface micrographs of some samples were taken to determine if there were any debonding effects due to the treatments. The surface micrographs do not reveal a dramatic debonding effect but cannot be used to dray any further conclusions on the bonding effect. The Hydrophobe 1 treated samples show that the condebelt treatment coats the fibers well with the rosin and that the rosin also has filled the pores. Hydrophobe 1 is 85% by weight rosin, while the rest is a kymene type molecule. The exact location of the rosin in the fiber still cannot be concluded from the images. The loading of the sheet is approximately 30 lb/ton of sizing pick up.

Raman Scattering

FT Raman scattering was used to try and understand the differences in sizing pick up across the different drying techniques for the organic sizes. The pick up was greater for the Condebelt treatment than the High impulse treatment. The treated area shows variation in rosin level across the sample. However, the very qualitative nature of these results makes it difficult to draw any quantitative conclusions.

Figure 4:
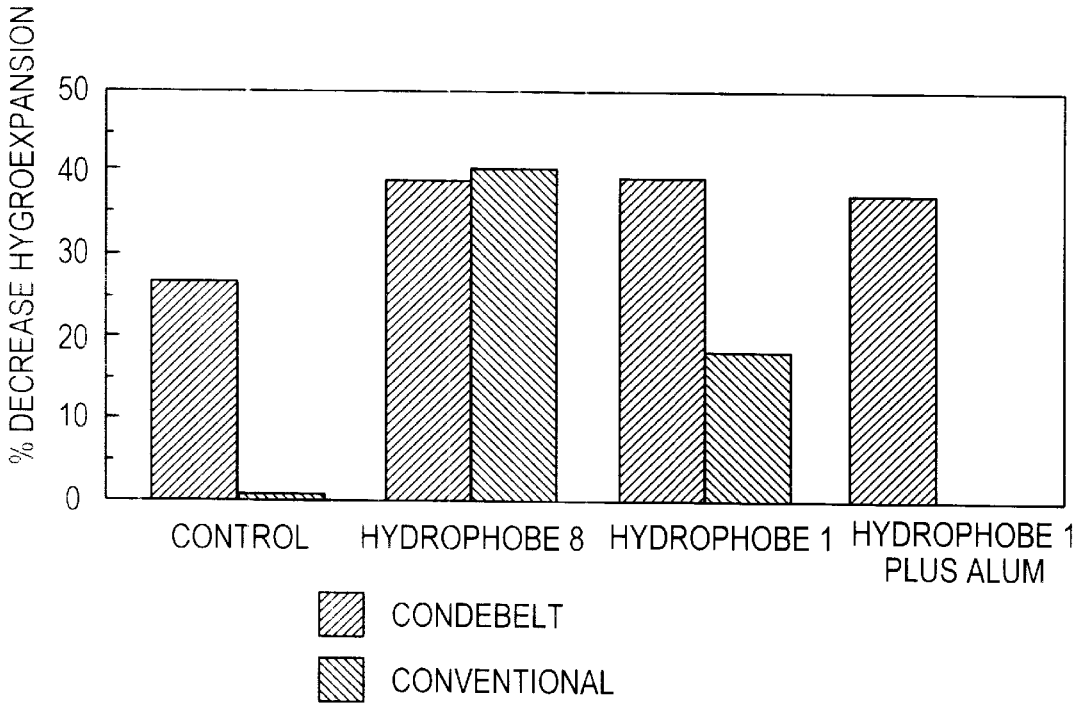
FIG. 4 is a graphic illustration comparing the hygroexpansion of various samples treated with Hydrophobes 1 and 8 in accordance with the invention.

The results indicate that a liner board product with lower compressive creep can be produced from the treated fibers. Using Condebelt and Hydrophobe 1 a reduction in hygroexpansion of 40% is seen. In terms of reduction of hygroexpansion, Hydrophobe 8, available from Arizona Chemical, performed well under conventional drying conditions. The level of Hydrophobe 1 added was at the 18 lb/ton and 30 lb/ton level (see FIG. 4). Laboratory studies show that the samples are repulpable under neutral conditions. The stretch of treated samples under cyclical humidity conditions the response curve of the treated samples show a damped response compared with the control sample indicating higher stability under cyclical humidity conditions.

Figure 5:
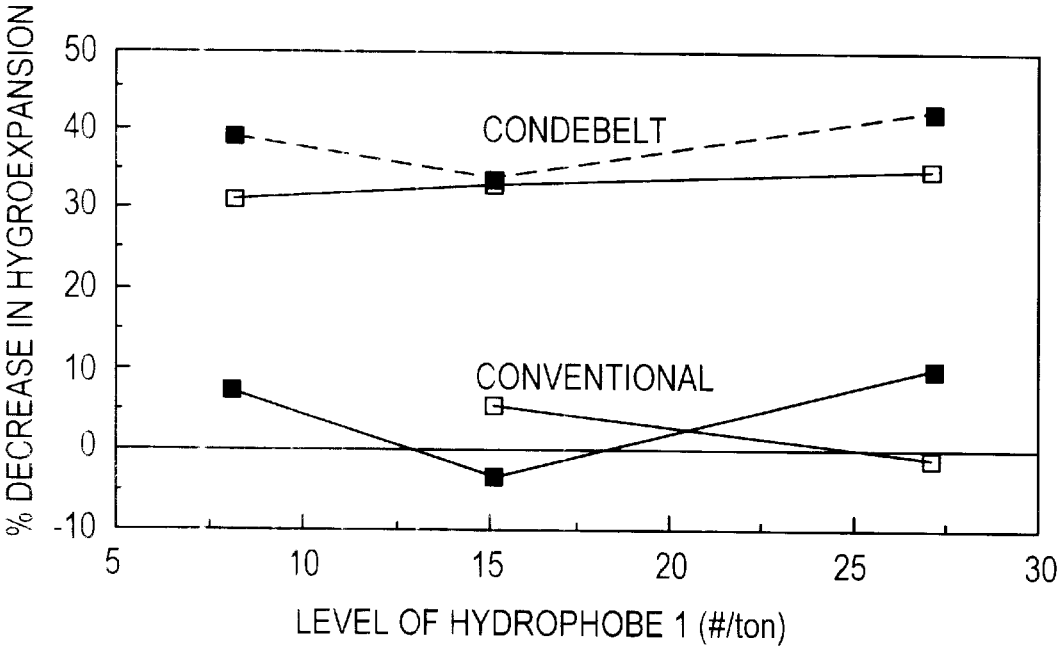
FIG. 5 is a graphic illustration of the effect of Condebelt drying and Hydrophobe 1 treated samples on the hygroreactivity of paper.

The treated fibers were reproduced in handsheets made from Camden 50 Kappa pulp dried on the static Condebelt and the results are summarized in FIG. 5.

Variations in the invention process include using different levels of sizing material; using wet end and different size press applications, using both blade/rod metering and puddle size; using different base sheets, in terms of composition as well as basis weight; using different pressure/heat/drying times; and using different pulps including bleached/unbleached and different Kappa.

EXAMPLE II

Figure 6:
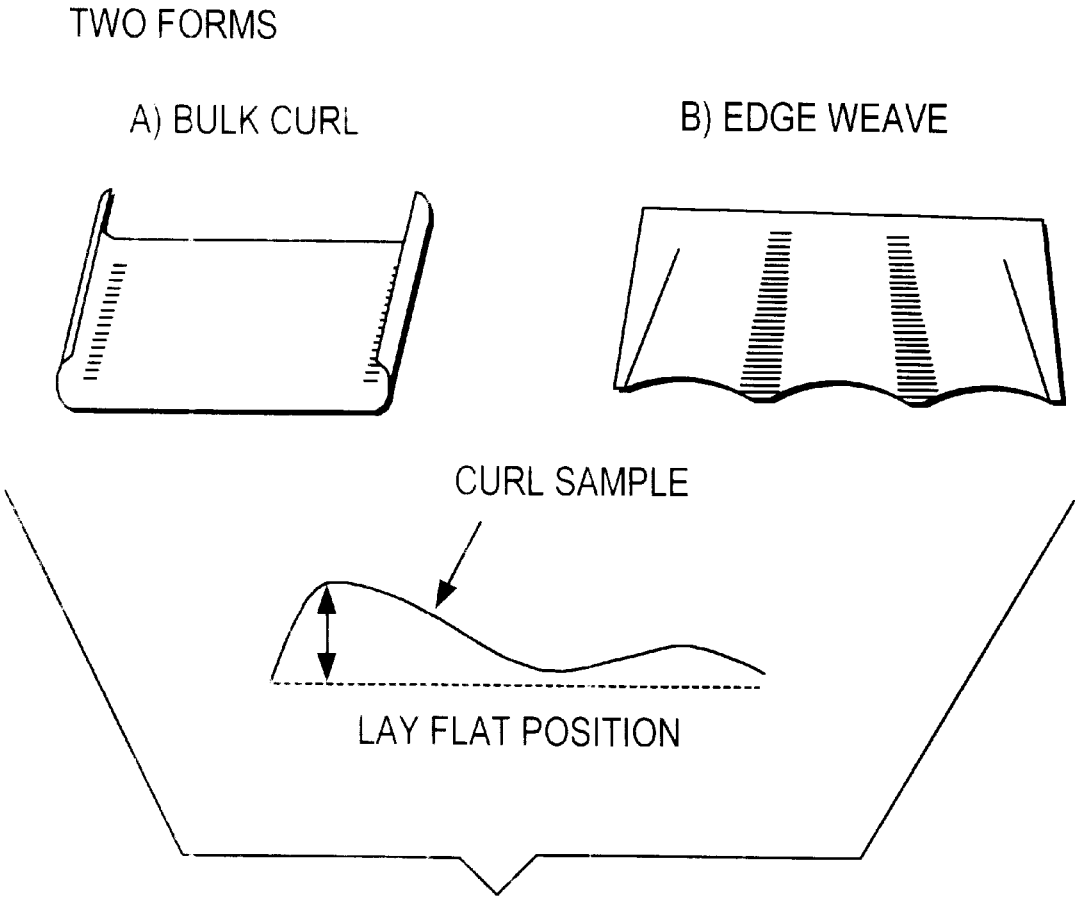
FIG. 6 is a diagrammatic illustration of the lay flat characteristics of a two sided polyethylene release liner made in accordance with the invention process.

In this example, a two sided polyethylene extruded release liner was produced in accordance with the invention process. The lay flat characteristics of liner is illustrated in FIG. 6.

Specifically, a non-hygro reactive paper/paperboard was created by treating a base sheet with a cationic rosin sizing agent, Sizeall XR 4177. This agent was applied in the size press and then dried using heat and pressure. Application in this manner was found to be the most effective, reducing hygroexpansion by approximately 49% as measured in a hygroexpansimeter. The hot polyethylene extruded on the basesheet helps rearrange the rosin in the sheet. The cationic nature of the sizing chemical also helps get good bond strength between the paper and the extruded polyethylene layer at high sizing levels (27 lbs ton). This enhanced paper-polyethylene bond permits one to omit the aqueous priming step, which in turn helps achieve a more uniform structure in the z-direction and reduce the propensity to curl. The aqueous priming step is typically used in conventionally known processes as a pre-treatment of the base sheet prior to polyethylene extrusion. The hydrophobic sizing solution of the invention eliminates this step.

Figure 7:
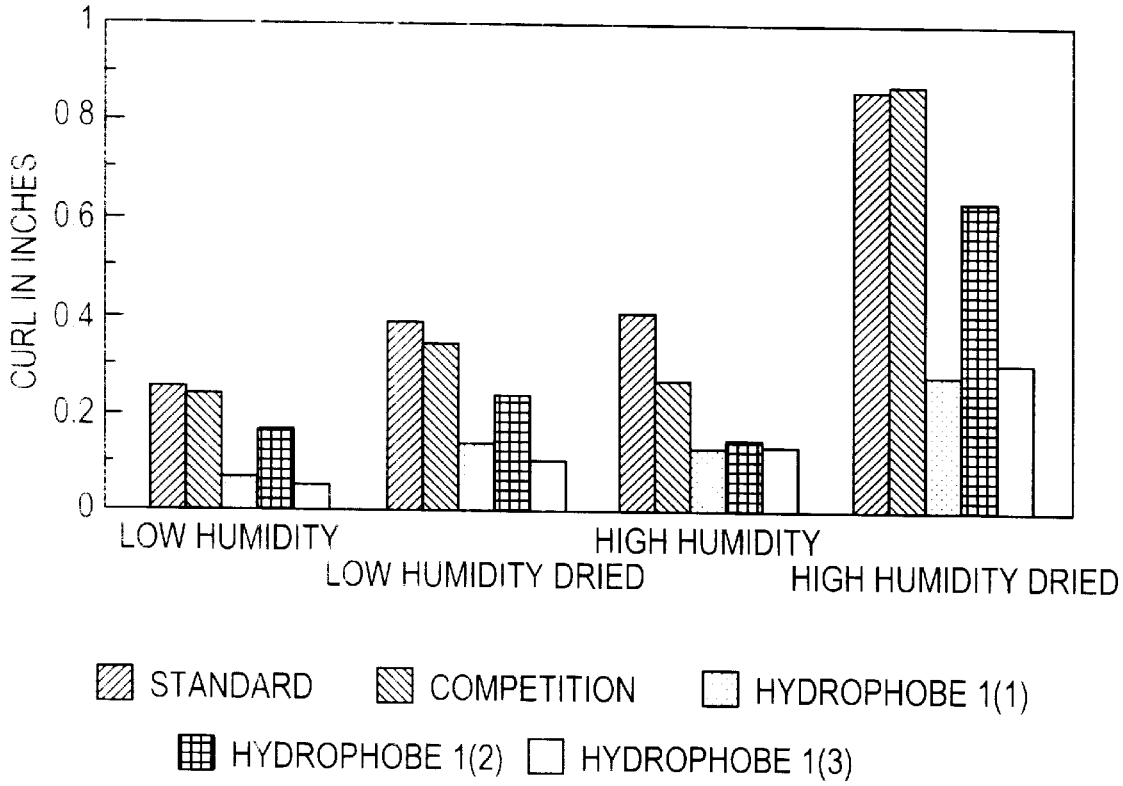
FIG. 7 is a comparison of the curl of a release liner made in accordance with the invention process, under various humidity conditions.

Compared to release liner made from standard product and conventional base sheet, the invention release liner exhibited the least amount of wavy edges, curl and damped moisture content changes in cyclical humidity conditions. This data is illustrated in FIG. 7.

Modeling studies and experimental evaluations showed that approximately 40 to 50% of the lay flat problem is attributed to the two sidedness of the extruded polyethylene layers. It is important to have a balanced coating. This involves using the same polyethylene on either side as well as the same coat weight on either side.

In addition, the invention process of surface sizing the base sheet with a hydrophobic surface size, i.e. Sizeall XR 4177, was found to improve the lay flat property of the release liners by an additional 20 to 30%.

Advantage over the prior art is in the reduction of the hygroexpansion of fine paper by ~40% and hence a more dimensionally stable paper/board. The technique uses a hydrophobic treatment of the fine paper which is dried using heat and pressure. Normally dried paper treated with a hydrophobe does not show this improvement at the lower dosage levels.

Although the invention has been described in terms of preferred embodiments numerous modifications are also included. For example, different levels of sizing materials can be incorporated into the fiber matrix. The aqueous hydrophobic sizing agent can be applied at different size press applications, using both blade and rod metering and puddle size. Other starches and gums as hydrophilic sizing materials can be used in addition to the ones described herein.

The foregoing description of the invention is further amplified by the respective embodiments in the examples, which however should not be construed as a limitation of the broader concept, but merely illustrative of the same.

In accordance with the present invention the pages attached to the specification hereto provide further details of the invention.

The invention now being fully described, it will be apparent to one of ordinary skill in the art that many changes and modifications can be made thereto without departing from the spirit or scope of the invention as set forth herein.

What is claimed is:

1. A method of producing dimensionally stable paper and/or paperboard products comprising:

treating a hygroreactive cellulosic fiber matrix with a hydrophobic agent comprising a dispersion of hydrophobes; and drying the treated fiber matrix under conditions including pressures from about 200 to about 400 psi and temperatures from about 300 to about 400° F. so that said hydrophobes penetrate into said fiber matrix making it hydrophobic.

2. The method according to claim 1, wherein said dispersion of hydrophobes is between 2 to 20 wt. % solids.

3. The method according to claim 1, wherein said dispersion includes up to 12 wt. % starch.

4. The method according to claim 1, wherein said dispersion includes up to 1 wt. % of said hydrophobic agent.

5. The method according to claim 1, wherein said hydrophobic agent is a modified cationic rosin dispersion comprised of 10–40% emulsified cationic rosin solids and 1–6% of a water soluble salt of an alkylene-acrylic acid copolymer.

6. The method according to claim 1, wherein said dispersion includes a surfactant.

7. A method according to claim 1, wherein said hydrophobic agent is selected from the group consisting of styrene acrylate copolymer dispersion, polyurethane, ethylene oxide and propylene oxide to block copolymer, polyethylene acrylate, chromium stearate, alkyltrimethoxysilane and turpene dimer.

8. The method according to claim 1, wherein said aqueous solution includes a surfactant.

9. The method according to claim 1, wherein said treated fiber matrix has a water contact angle of 90°or greater.

10. A method of producing dimensionally stable paper and/or paperboard products comprising:

treating a hygroreactive cellulosic fiber matrix with a hydrophobic agent comprising a dispersion of hydrophobes, wherein the weight ratio of hydrophobes to cellulosic fibers is between 1:333 and 1:333; and drying the treated fiber matrix under conditions including pressures from aboyt 200 to about 400 psi and temperatures from about 300 to 400°F. so that said hydrophobes pnentrate into said fiber matrix making it hydrophobic.

11. The method according to claim 10, wherein said dispersion of hrdrophobes is between 2 to 20 wt. % solids.

12. The method according to claim 10, wherein said dispersion includes up to 12 wt. % starch.

13. The method according to claim 10, wherein said dispersion includes up to 1 wt. % of a hydrophobic agent.

14. THe method according to claim 10, wherein said hydrophobic agent is in the form of a modified cationic rosin dispersion comprised of 10–40% emulsified cationic rosin solids and 1–6% of a water soluble salt of an alkylene-acrylic acid copolymer.

15. The method according to claim 10, wherein said hydrophobic agent is selected from the group consisting of styrene acrylate copolymer dispersion, polyurethane, ethylene oxide and propylene oxide block copolymer, polyethylene acrylate, chromium stearate, alkyltrimethoxysilane and turpene dimer.

16. The method according to claim 10, wherein said dispersion includes a surfactant.

17. The method according to claim 10, wherein said treated fiber matrix has a water contact angle of 90°of greater.

18. A method of producing dimensionally stable paper and/or paperboard products comprising:

treating a hydroreactive cellulosic fiber matrix with a hydrophobic agent in the form of a modified cationic rodin dispersion comprised of 10–40% emulsified cationic rosin solids and 1–6% of a water soluble salt of an alkylene-acrylic acid copolymer; and drying the treated fiber matrix under conditions including pressures from about 200 to about 400 psi and temperatures from about 300 to about 400°F. so that said hydrophobes penetrate into said fiber matrix making it hydrophobic.

* * * * *